United States Patent [19]

Oakman

[11] Patent Number: 4,890,692

[45] Date of Patent: Jan. 2, 1990

[54] PLATFORM ELEVATING APPARATUS

[75] Inventor: Willard R. Oakman, McConnellsburg, Pa.

[73] Assignee: JLG Industries, Inc., McConnellsburg, Pa.

[21] Appl. No.: 280,645

[22] Filed: Dec. 6, 1988

[51] Int. Cl.[4] ..... E04G 1/22

[52] U.S. Cl. ..... 182/141; 187/18; 254/122

[58] Field of Search ..... 182/141, 148, 63, 69; 187/18; 254/122

[56] References Cited

U.S. PATENT DOCUMENTS

| | | | |
|---|---|---|---|
| 2,402,579 | 6/1946 | Ross . | |
| 2,501,001 | 2/1947 | Neely . | |
| 2,533,980 | 12/1950 | Weaver . | |
| 3,032,319 | 5/1962 | Dale | 187/18 |
| 3,446,379 | 5/1969 | Phillips . | |
| 3,472,183 | 10/1969 | Goodman | 254/122 |
| 3,700,070 | 10/1972 | King . | |
| 4,114,854 | 9/1978 | Clark . | |
| 4,130,178 | 12/1978 | Smith, Jr. . | |
| 4,194,723 | 3/1980 | Grove et al. . | |
| 4,457,403 | 7/1984 | Ream . | |
| 4,549,720 | 10/1985 | Bergenwall | 187/18 |
| 4,690,250 | 9/1987 | Bergstom | 182/141 |

*Primary Examiner*—Reinaldo P. Machado

*Attorney, Agent, or Firm*—Foley & Lardner, Schwartz, Jeffery, Schwaab, Mack, Blumenthal & Evans

[57] ABSTRACT

An elevating device for a workman's platform in which a single lift cylinder is utilized, positioned below the lift arms when the arms are in their fully retracted or lowered position. A piston of the cylinder is operatively connected to one of the lift arms, with the opposite end of the cylinder being operatively connected to one end of a pivot arm assembly which is mounted for rotation about a fixed axis on the base. The opposite end of the pivot arm assembly carries a roller which is adapted to engage the cam surface of a cam plate mounted on the same lift arm. When the lift cylinder is actuated, the piston functions to raise the lift arm at its connection point to the piston, simultaneously with the rotation of the pivot arm assembly and the consequent lifting of the cam roller against the cam surface thereby elevating the arm at that location as well. This lifting at points on either side of a central connecting point of the lift arm reduces the initial lifting force required thereby permitting a single lift cylinder to be employed.

6 Claims, 3 Drawing Sheets

PLATFORM ELEVATING APPARATUS

BACKGROUND OF THE INVENTION

This invention relates generally to apparatus for elevating personnel and/or loads utilizing scissor-type linkage.

Aerial work platforms generally comprise a wheeled base, which is normally self-propelled, and a platform which may be raised or lowered relative to the base by means of scissor-type linkage arms. Typically, these scissor-type arms are hydraulically powered to be moved between a folded, lowered position to an extended, raised position, with the height of the work platform being varied as desired by the operator.

Providing sufficient hydraulic power to raise and lower the platform requires the provision of lift cylinders which are actuated to apply a force to the arms thereby moving them between the folded and extended positions.

A limitation in providing sufficient hydraulic power relates to the overall height of the platform when the arms are folded on the base. As low a height as possible is desirable so that the apparatus can be moved into and from areas having restricted entryways. Vertically mounted hydraulic cylinders obviously offer the most efficient mechanical advantage. This arrangement is shown in U.S. Pat. No. 4,194,723, assigned to the assignee of the present invention. Due to height restraints, such vertically oriented cylinders are not always acceptable or desirable. As an alternative, the cylinders are usually mounted at some angle relative to the arms, which reduces the overall vertical height with respect to the folded platform. However, a result of such angular mounting is a loss of mechanical advantage of leverage since the folded arms and the cylinder are connected so as to form a very small acute angular relationship. In fact, the cylinders and arms are frequently almost parallel when the lift arms are retracted. This requires greater hydraulic force to raise the platform. After the arms are partially extended and the cylinder is pivoted to a more vertical position, the leverage problem is reduced.

An attempt to overcome this problem is disclosed in U.S. Pat. No. 4,114,854. In the lift platform described, a cylinder moves a pivot arm upwardly toward the lift arms. The pivot arm co-acts with a cam connected to the scissor lift arms. The resultant force provides a slight mechanical advantage over connecting the cylinder directly to the scissor lift arms, but the vertical force component is still not as large as desired.

The foregoing illustrates typical limitations known to exist in present lift arrangements. Thus, it is recognized that it would be advantageous to provide a more efficient lifting system for scissor lift equipment, and the present invention is believed to meet that need.

SUMMARY OF THE INVENTION

The invention is principally characterized by having a very low height when the lift or scissor arms are retracted. This is accomplished in the preferred form shown by using a single lift cylinder positioned entirely below the lift arms in their lowermost position. This very low profile greatly enhances the maneuverability of the apparatus. In fact, the apparatus when retracted is able to go through an entryway of normal door height, 80 inches, without removing the rails of the platform.

A further object is to provide a lifting arrangement in which the mechanical advantage between the lift cylinder and the lift arms of the platform elevating apparatus is increased relative to known lifting arrangements of this general type. The mechanical advantage is obtained by mounting a cam plate on one end of one of the lowermost lift arms, with the plate being engaged by a cam roller carried at one end of a pivot arm assembly mounted for rotation on the base or chassis of the machine. The cam roller engages the cam plate during initial lifting to provide a second vertical lift component to the lift arm, the opposite end of which is connected directly to the piston of the lift cylinder. This initial lifting force at two points on the lift arm permits a single lift cylinder to be used.

When the lift arms have been moved vertically a predetermined distance, the cam plate moves away from the cam roller. However, at that point in travel, the lift arms can be further elevated without difficulty by the single lift cylinder. At the point where the cam roller disengages the vertically moving cam plate, the pressure of the lift cylinder both on the roller and immediately when it leaves engagement with the roller is approximately the same, thereby eliminating any lurch or sudden movement of the lift arms.

A further advantage of the present invention is the compact, lateral dimensions of the lift arms. The use of a single lift cylinder permits a single inner arm to be used, flanked by and interconnected to the outer lift arms. The piston end of the lift cylinder is attached to such inner arm, as is the cam plate which is engaged by the cam roller. This use of a single inner arm and a pair of surrounding outer arms substantially reduces the width of the entire assembly without sacrifice of lift power.

These and other objects will become apparent as the following description proceeds in particular reference to the application drawings.

DESCRIPTION OF THE PRIOR ART

Figure 1:
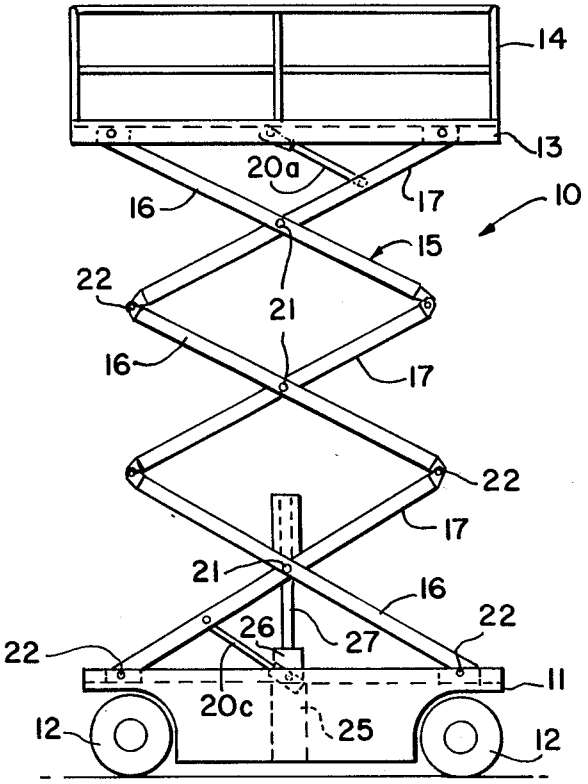
FIG. 1. (PRIOR ART)
FIG. 1 illustrates a known prior art scissors linkage for a workman's platform, utilizing a vertically oriented lift cylinder and showing the lift arms in an elevated position.

FIG. 1 illustrates a workman's platform disclosed in U.S. Pat. No. 4,194,723, and will be briefly described to provide relevant background to the present invention. The platform is generally indicated at 10 and is mounted on a base or chassis 11 having wheels 12. Conventional motor and pump means are provided to drive the equipment and lift the arms. These are well known in the art and have accordingly not been illustrated. A deck 13 having a guard rail 14 is attached to the upper ends of the uppermost lift arms 16 and 17. The lift arms are provided in pairs, with the arms 17 being positioned within the outer arms 16. The arms 16 and 1 are pivotally interconnected at their centers by pins 21, and at their ends by pivot pins 22.

A hydraulic motor 25 is mounted in the chassis, with pistons 26 and 27 being driven by the motor. The piston 27 engages the lowermost center pin connection 21 for elevating the lift arms with upper and lower centering links 20*a* and 20*c* being provided to ensure the equal upward and downward movement of the arms 16 and 17.

Although the vertical orientation of the lift cylinder in the FIG. 1 prior art arrangement provides maximum lifting efficiency, such orientation requires substantial height and places a practical restriction on the overall height of the platform when fully retracted. Moreover, the use of pairs of lift arms 16 and 17 are provided so as to result in a substantial lateral dimension.

DETAILED DESCRIPTION OF THE PREFERRED EMBODIMENTS

Figure 4:
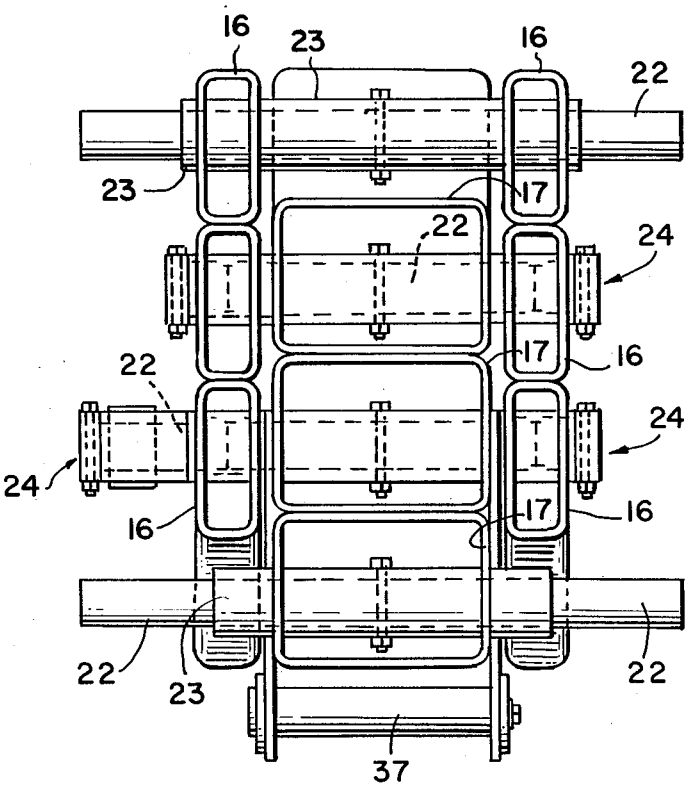
FIG. 4 is an end view taken on line 4—4 of FIG. 2.
Figure 2:
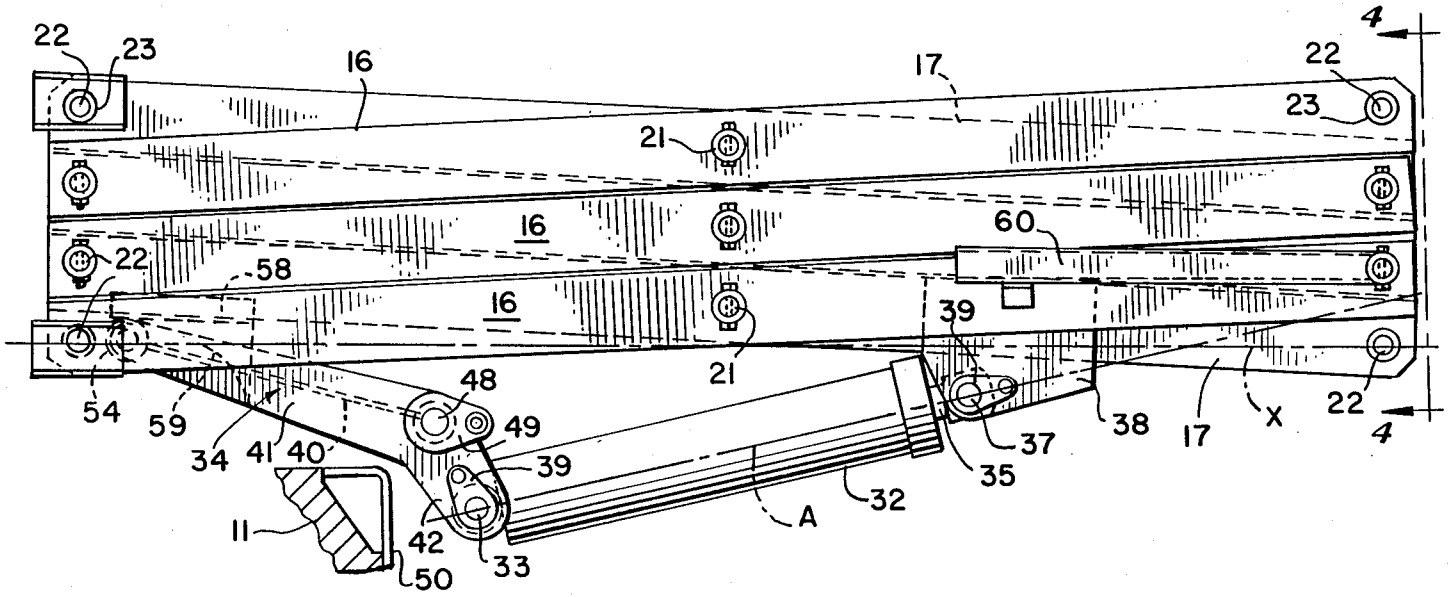
FIG. 2 illustrates the scissor or lift arms of the present invention in a lowered or retracted position, with the pivot arm assembly and lift cylinder being operably connected or engaging one of the lower lift arms.
Figure 3:
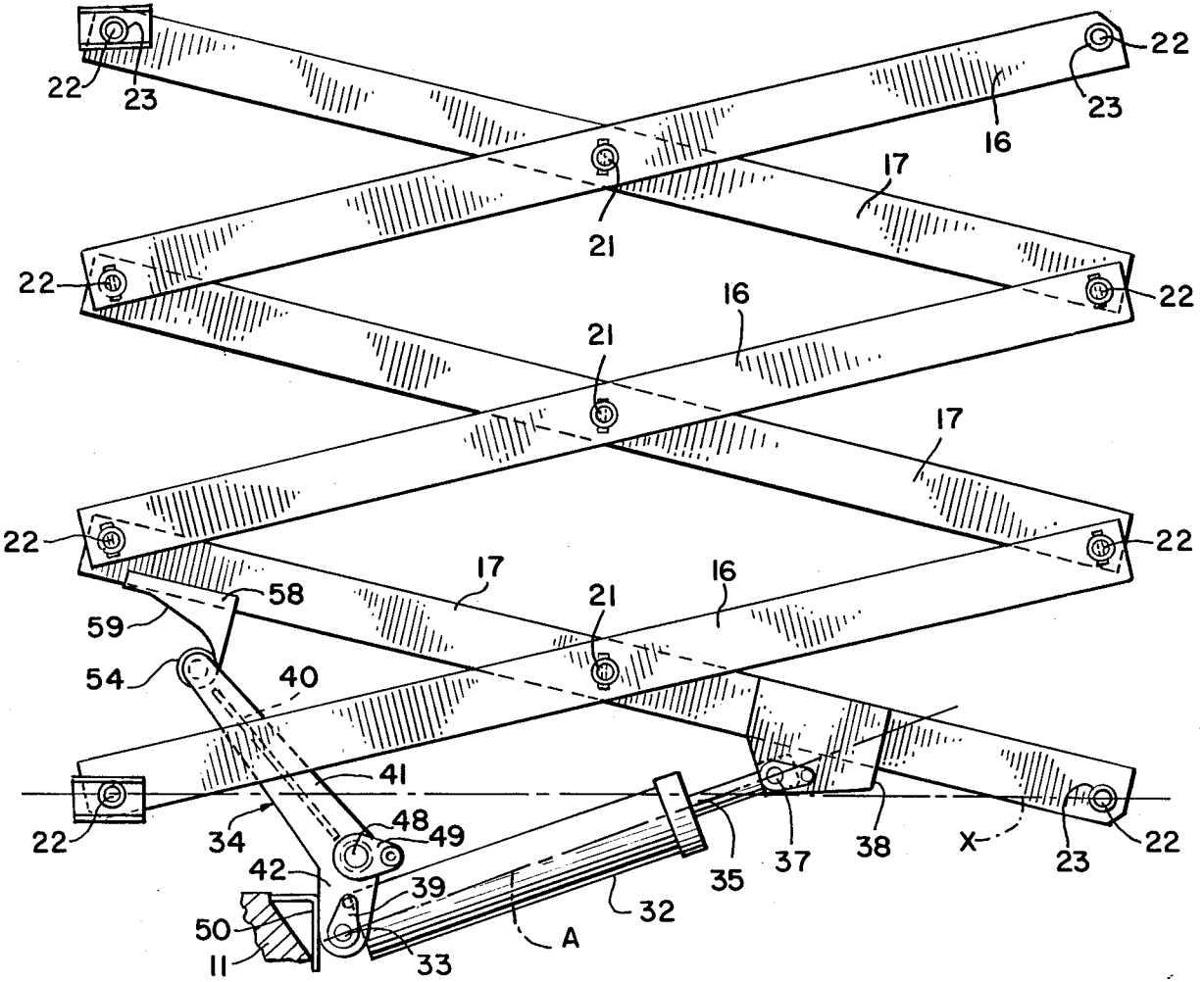
FIG. 3 is a side elevational view similar to FIG. 2 but showing the lift arms elevated. In both FIGS. 2 and 3, the base and platform have not been illustrated for sake of clarity.

The improvements comprising the present invention are illustrated in FIGS. 2–4, in which certain parts corresponding to the parts shown in FIG. 1 are identified by the same reference numerals. In FIG. 2, the scissor or lift arms 16 and 17 are shown in their lowermost, retracted position. In order to provide clarity of illustration, the mounting of the lower scissor arms to the chassis is not illustrated, although it will be understood that the lowermost pivot pins 22 having axes extending through plane X are mounted on the frame and are accordingly vertically fixed. Thus, the vertical movement of the scissors lift arrangement is about the two fixed pivot pins 22, as clearly evident in FIG. 3. Similarly, the uppermost pins 22 as shown in FIGS. 2 and 3 are fixedly secured to the platform, similarly not shown in these figures.

As shown in FIG. 4, the lift arms 16 and 17 at their ends are rotatably mounted on pins 22 which are positioned within bearing sleeves 23 which extend through openings formed in the arms 16 and 17. The narrower outer arms 16 are positioned on either side of the single inner arm 17. Collar and pin assemblies commonly and generally indicated at 24 serve to retain the pins and sleeves. The fact that only a single inner tube or arm 17 is used reduces the width of the lift arm assembly. In the preferred embodiment, the width of the machine is approximately 33" which, together with its compact height, permits the machine to pass through a normal door opening.

Referring to FIGS. 3 and 4, a single lift cylinder 32 is provided, one end of which (the leftmost end shown in these figures) is connected to a pin 33 mounted on pivot arm assembly 34. A piston 35 extends from the other end of the cylinder 32, with the piston 35 carrying a clevis 36 at its end which is mounted on pin 37. Pin 37 extends through the spaced sidewalls of a mounting plate 38 which is secured to the lowermost inner arm 17. Bolted retainer members 39 are positioned around the outer ends of the pins 33 and 37 to retain the pins nonrotatably in their respective mountings. It will be noted that the axes of the pins 33 and 37 are coaxial with the longitudinal axis A of the cylinder 32.

The pivot arm assembly 34 comprises two spaced arms identical in shape and interconnected by web 40. The arms comprise a longer section 41 and a relatively shorter section 42 which extends at an obtuse angle to the section 41. The arms are pivoted about a fixed pin 48 secured to the base of the machine with retainer members 49 being similarly provided. A stop member 50 is also mounted on the base 11 and functions in a manner to be presently described.

As best known in FIG. 3, a cam plate 58 having a cam surface 59 is mounted on the same inner arm 17 as the mounting plate 38 which supports the pin connection to the piston 35 of the lift cylinder. The cam plate 58 and plate 38 are on opposite sides of the center pin connection 21 and are positioned above the lift cylinder 32, as can be seen in FIG. 2. A cam roller 54 is mounted between the outer ends of the spaced arm sections 41.

When the platform is in its fully retracted position, reference being made to FIG. 2, the sections 42 of the pivot arm assembly 34 are spaced from the stop 50, and the cam roller 54 contacts the cam surface 59 adjacent its outer end. In this retracted position, it will be noted that the lowermost outer arm 16 extends at least partially below the cam plate 58.

When it is desired to elevate the platform, lift cylinder 32 is actuated in a conventional manner which forms no part of the present invention, thereby extending piston rod 35. At the same time, the pivot arm assembly 34 is caused to rotate about pin 48 in a clockwise direction. The cam roller 54 acts vertically against the cam surface 59 and provides supplemental lifting motion to the lower arm 17 at the end thereof opposite the connection of the lower arm to the piston rod 35. Thus, the lowermost arm 17 is caused to be pivoted upwardly about its fixed pivots 22, thereby effecting the elevation of the entire lift assembly. The initial assistance by the cam roller substantially reduces the initial lifting requirements, and permits a single lift cylinder to be used.

When the piston rod 35 is further extended, the pivot arm assembly 34 continues to rotate clockwise about the axis through pin 48, until the front face of the arm section 42 engages the surface of the stop member 50. When such engagement occurs, the cam roller 54 has traversed essentially the entire length of the cam surface 59, as can be seen in FIG. 3. When the piston rod 35 is further extended, the lowermost inner arm 17 continues its upward movement, and the cam plate 58 moves upwardly to disengage the cam roller from the surface 59.

The configuration of the cam surface is 15 designed such that there is no lurching of the platform when the cam plate is lifted free of the roller, nor is there any lurching when the cam plate 58 engages the roller during the retraction process. During the initial lifting, the force vector applied by the cam roller 54 to the surface 59 is primarily vertical in order to achieve the desired supplemental lifting effect. As the cam roller 54 moves along the cam surface 59 as the arms are lifted, the lift cylinder pressure required to lift the arm at that point increases due to the curvature of the cam surface. At the position of the cam roller shown in FIG. 3, the cylinder lift pressure is approximately the same as when the roller disengages the cam surface. Thus, a smooth transition during disengagement of the cam roller occurs during continued lifting of the arms, and a similarly smooth engagement of the cam surface with the cam roller occurs during retraction.

Referring to FIG. 2, a safety prop 60 which is conventional in both structure and function is rotatably mounted on the lift assembly about one of the pins 22. The prop can be rotated to a vertical supporting position when the arms are partially lifted, in a known manner.

It will thus be seen that the present invention provides significant advantages over prior art scissor lift arrangements of this general type. By providing lifting at spaced points along the lower lift arm, the lifting force can be considerably reduced thereby permitting platform lifting by a single lift cylinder. The lift cylinder is mounted beneath the lift arms even when the arms are retracted, with the lift cylinder being operably connected to a single inner arm. This permits a substantial reduction in the width of the lift arms as well as the height of the assembly when fully retracted.

Although a single inner arm is greatly preferred for the reasons indicated, the supplemental lifting provided by the pivot arm assembly could be utilized with lift arm assemblies provided in pairs. However, a suitable support would have to be provided for the cam plate, and such arrangement would lose the important feature of decreased width.

The foregoing is a description of the preferred embodiment of the invention, and changes will suggest themselves to one skilled in the art without, however, departing from the scope of the invention as defined by the appended claims.

What is claimed is:

1. An elevating device for a workman's platform having a base and a platform vertically movable between a fully retracted position and a raised position, comprising:

(a) a plurality of interconnected lift arms having central and end pivotal interconnecting points, certain lower of said lift arms being adapted for pivotal connection to the base and certain upper of said lift arms being adapted for pivotal connection to the platform;

(b) a power lift cylinder mounted entirely below said lift arms when said arms are fully retracted, said cylinder having an extendible piston pivotally connected at one end to one of said lower lift arms;

(c) a cam plate connected to said one lower lift arm at a point on the opposite side of said central interconnection point of said one lower lift arm, said cam plate having a cam surface, (d) pivot arm means mounted for rotation about a horizontal fixed axis, one end of said pivot arm means being operatively connected to the end of said lift cylinder opposite said piston, and the other end of said pivot arm means having mounted thereon a cam roller for engaging said cam surface when said lift arms are retracted and during initial lifting movement of said arms from such retracted position, said cam roller and cam surface being so oriented as to provide a vertical lifting force on said one lower lift arm when said power lift cylinder is actuated, whereby actuation of said lift cylinder to raise said arms and platform results in rotation of said pivot arm means and lifting of said cam roller whereby said one lower lift arm is raised both at its connection to the cylinder piston and at the point of engagement between said cam surface and said cam roller.

2. The elevating device of claim 1 wherein said lift arms comprise a single inside arm on either side of which is positioned an outside arm, with said cylinder being pivotally connected to said inside arm, and said cam plate being mounted on the opposite end of said inside arm.

3. The elevating device of claim 1 wherein said pivot arm means comprises a pair of spaced and interconnected pivot arms, said cam roller extending between each arm to provide an elongated contact surface with said cam plate.

4. The elevating device in claim 3 wherein each of said pivot arms is comprised of a relatively elongated section, the outer end of which has mounted thereon said cam roller, and a relatively short section extending at an obtuse angle to said elongated section and operably connected to said cylinder, the axes of said elongated and relatively short sections intersecting at the fixed axis for mounting said support arms.

5. The elevating device of claim 1 wherein said cam surface is less inclined relative to the horizontal at its outer end which is engaged by said cam roller when the lift arms are fully retracted, and substantially more inclined near its opposite end which is engaged by said cam roller after initial lifting of said lift arms.

6. The elevating device of claim 1 further including a stop means fixedly mounted on said base, said pivot arm means contacting said stop means to terminate rotation of said pivot arm means and consequently the supplemental lifting effect caused by engagement of said cam roller with said cam surface.

* * * * *